United States Patent [19]

Staley

[11] Patent Number: 4,813,883

[45] Date of Patent: Mar. 21, 1989

[54] IMPACT FASTENING ELECTRICAL WIRE CONNECTOR

[76] Inventor: Donald K. Staley, 4212 Holland Dr., Des Moines, Iowa 50310

[21] Appl. No.: 28,226

[22] Filed: Mar. 23, 1987

[51] Int. Cl.[4] ..... H01R 4/24

[52] U.S. Cl. ..... 439/391; 439/402

[58] Field of Search ..... 439/391, 393, 395-397, 439/399, 402, 403, 409, 443, 444, 201, 204

[56] References Cited

U.S. PATENT DOCUMENTS

| | | | |
|---|---|---|---|
| 2,587,239 | 2/1952 | Smith | 439/391 |
| 3,522,576 | 8/1970 | Cairns | 439/201 |
| 3,644,875 | 2/1972 | O'Loughlin | 439/391 |
| 3,890,029 | 6/1975 | Izraeli | 439/402 |
| 4,415,215 | 11/1983 | Goozner | 439/402 |
| 4,444,448 | 4/1984 | Silbernagel et al. | 339/98 |
| 4,579,413 | 4/1986 | Weidler | 439/398 |

*Primary Examiner*—P. Austin Bradley

[57] ABSTRACT

This invention is an electrical connecting device which serves to make electrical contact between two or more electrical wires while simultaneously anchoring them to firmly resist physical separation of the connection. The novelty of the device is its adaptation for use in a system which enables connections to be made rapidly in continuous succession.

5 Claims, 2 Drawing Sheets

IMPACT FASTENING ELECTRICAL WIRE CONNECTOR

BACKGROUND OF THE INVENTION

The field of electrical wire connectors features a wide variety of devices which all perform the same basic function of physically joining and electrically bridging two or more electrical wires. Over the history of electrical connector art, many devices have been invented and patented, yet to date, the most commercially successful device continues to be a simple wire connector developed in the early stages of the art. This connector, commonly referred to as the electrical wire nut, maintains its prominence in the field despite several attempts to replace it in the decades following its inception.

The sustained market appeal of the wire nut does not mean it is without disadvantages. Using the device requires a tedious application process. The user is required to strip the wires of insulation, to align and group the wires into a small bunch and to forcefully twist the device onto the wire grouping. Once the device is applied, there is a likely chance that one or more of the wires will not be properly anchored allowing the connection to become loose after being placed in service.

Several inventions have been developed with the expressed intention of replacing the wire nut. Some such devices include the Snap Type Connector (U.S. Pat. No. 2,587,239), the Partitioned Electrical Connector (U.S. Pat. No. 3,890,029) and the Solderless Electrical Splice (U.S. Pat. No. 4,415,215). These inventions have been eliminated the need to strip wires of insulation and have substantially reduced the potential for loose connections; however, in the process of eliminating disadvantages these devices have sacrified many of the advantages the wire nut offers including versatility, simplicity and cost effectiveness.

The wire nut, when properly installed, provides a sound connection that is physically tough and compact. A single wire nut can handle a variety of wire combinations including both solid and stranded wires and wires of varying size. Above all, the wire nut is simple allowing it to be manufactured cheaply with a minimal amount of assembly.

The object of the invention described herein is to provide all the advantages of the connectors mentioned above without sacrificing advantages existing in the wire nut. The subject device provides a reliable connection while minimizing the labor required for application. Unlike the Snap Type Connector, this invention provides a physically tough connection which encases the ends of the wires within its insulated housing. Unlike the Partitioned Electrical Connector and the Solderless Electrical Splice, this connector is simple in its design requiring a small amount of assembly during its manufacture.

The most significant advancement of this invention is its special adaptation for being mechanically applied. Prior art in the field of electrical wire connectors has produced devices intended for hand application. While this invention permits hand application, its novelty is its ability to fit into the cartridge of a mechanical tool which enables connections to be made rapidly in continuous sequence. When mechanically applied, implementation of the subject device requires only that the ends of the wires be cut cleanly and inserted into the device deeply enough to insure that an adequate length of wire conductor is available for connection.

SUMMARY OF THE INVENTION

The impact fastening electrical wire connector described herein comprises three components: an insulating housing, a conductive connecting element and an insulating fastener. The housing is a hollow hexagonal cylinder with one open end and a slotted opening centrally located across its top surface. The connecting element is a thin plate of resilient, highly conductive material which is shaped like an arrowhead. The edges along the point of the connecting element are sharpened to form a wedge-shaped cutting edge hereafter referred to as its cutting wedge. The base of the connecting element is fixed into the fastener which is a clasping mechanism designed to lock the connecting element into the housing. The top of the fastener is shaped like the head of a tack while the lower portion of the fastener is shaped with incline planes which form the fastening mechanism. The fastener also serves as an insulating cover to seal slot in the housing.

Prior to application, the connecting element is positioned generally above the insulating housing with the tip of its cutting wedge inserted into the slot in the housing. The fastener, fixed onto the base of the connecting element, is postioned outside the wall of the housing with its clasping mechanism directed toward the slot in the housing.

During the application process, the connected wires are inserted into the housing through the open end. The housing serves to cradle the wires and to hold them in a generally parallel configuration. Downward force is applied to top of the fastener which drives the connecting element into the slot in the housing. As the connecting element travels downward its cutting wedge slices through the wire insulation and wedges the wires against the walls of the housing. The combined cutting and wedging action causes the connecting element to become deeply embedded into the wire conductors. When the connecting element reaches its closed position, the fastener clasps into the slot in the housing thereby locking the connecting element in place and trapping the connected wires within the housing.

The most practical means of applying downward force on the connecting element is to strike the top of the fastener with a tool capable of delivering such an impact. A simple tool with an action resembling that of a staple gun may be used for this purpose. Using an impact force to apply the subject device enables the connecting element to deeply penetrate the wire conductors assuring an electrically sound and physically tough connection.

The basic design of this invention accommodates connection of both solid and stranded wires. The connecting element may be varied to best suit the intended application. The cutting wedge for solid wires has smooth sharp edges for clean slicing of the wire insulation and deep penatration into the wire conductors. The cutting wedge for stranded wires has jagged edges with sharp teeth for deep penatration into the wire conductor without completely slicing through the wire insulation. "A cutting wedge that is suitable for connecting both solid and stranded wires will feature shallow serrations on a generally smooth cutting edge."

The concept of this invention permits several variations to enhance its versatility. These variations include expanding the subject device to accommodate connection of more than two wires and manufacturing the subject device to provide a waterproof connection once placed in service.

This invention supplants the Snap Type Connector patented by Smith (U.S. Pat. No. 2,587,239) in 1952 by providing a physically tough connection which is capable of withstanding strain against the connection, by encapsulating the ends of the connected wires within a one-piece insulating housing, by providing a cutting wedge that takes advantage of an inclined cutting edge to overcome penetration refusal experienced by a straight cutting edge and by providing an embodiment that permits it to be mechanically applied using a simple impact tool resembling a staple gun.

This invention supplants the Partioned Electrical Connector patented by Israeli (U.S. Pat. No. 3,890,029) in 1975 by providing a simple embodiment featuring a one-piece housing and simple cutting wedge requiring minimal assembly during manufacture, by providing versatility in handling both solid and stranded wires and by providing an embodiment configuration that permits mechanical application.

This invention supplants the Solderless Electrical Splice patented by Goozner (U.S. Pat. No. 4,415,215) in 1983 by providing a simple embodiment that is economical to manufacture, by providing a simple application procedure and by providing an embodiment that permits mechanical application.

THE DRAWINGS

FIG. 1 - a perspective view of the wire connector as it appears when placed in service;

FIG. 2 - a view of the typical connecting element for use with stranded wires;

FIG. 3 - a view of the typical connecting element for use with solid wires;

FIG. 4 - a longitudinal cross-section of the device shown in FIG. 1 before it is applied;

FIG. 5 - a transverse cross-section of the device shown in FIG. 1 before it is applied;

FIG. 6 - a longitudinal cross-section of the device shown in FIG. 1 after it is applied;

FIG. 7 - a transverse cross-section of the device shown in FIG. 1 after it is applied;

FIG. 8 - a view of the means by which the device may be expanded to accomodate additional wires.

DESCRIPTION OF A PREFERRED EMBODIMENT

Figure 1:
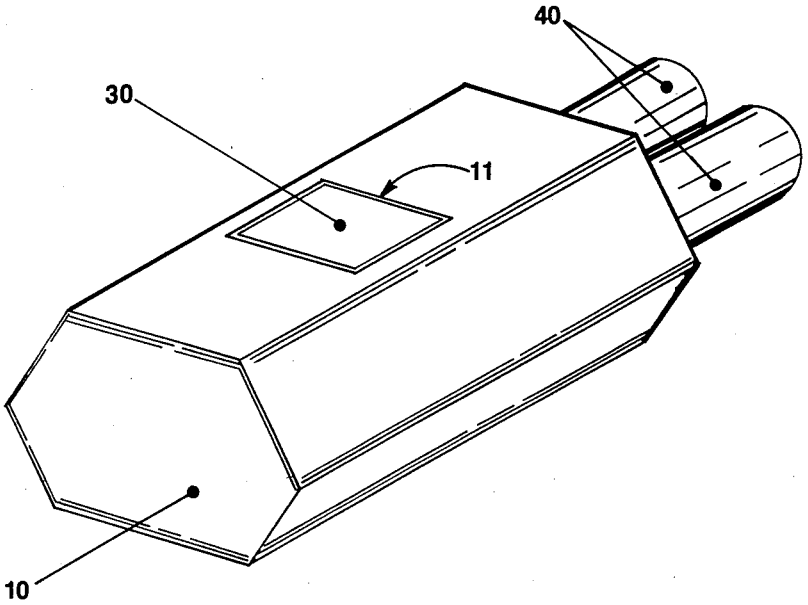

Referring to FIG.1, the electrical connector which is the subject of the invention herein, is shown as it appears when placed in service. The subject device comprises an insulating housing 10 which envelops the ends of the connected wires 40 and holds them in a generally parallel configuration; a connecting element 20 which grasps the connected wires 40 while providing electrical contact; and an insulating fastener 30 which is fixed onto the connecting element 20 and is configured to clasp into a slotted opening 11 in the housing 10.

Figure 4:
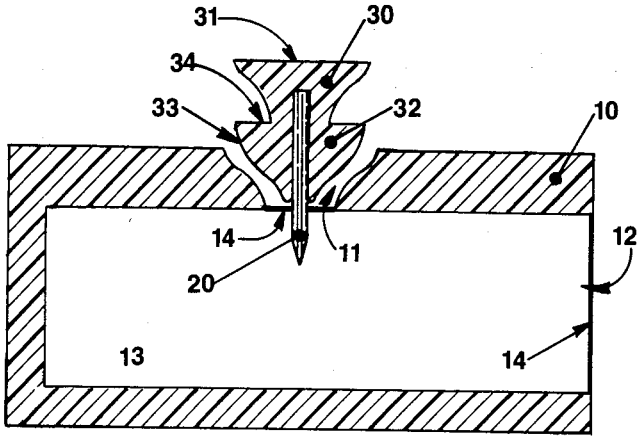
Figure 5:
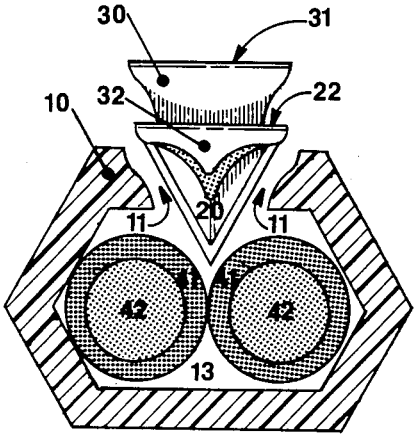

Referring to FIG. 1, FIG.4 and FIG.5, the insulating housing 10 is generally a hollow hexagonal cylinder with a single opened end 12 through which the ends of the connected wires 40 are inserted into the subject device. The internal cavity 13 of the housing 10 is a widened hexagonal cylinder which cradles the connected wires 40. The housing 10 features a slot 11 centrally located on its top surface through which the connecting element 20 accesses the connected wires 40. The slot 11 in the housing 10 is configured to facilitate the insertion of the connecting element 20 and the subsequent clasping of the insulating fastener 30. A thin, penetrable membrane 14 spanning the slot 11 is provided to hold the connecting element 20 in position prior to use of the subject device.

Figure 3:
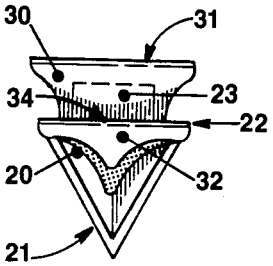

Referring to FIG.3 and FIG.5, the connecting element 20 is a thin, blade-like plate made of resilient, highly conductive material which is generally shaped like an arrowhead. The connecting element 20 has two sharpened adjacent edges which form an acute angled cutting wedge 21. The connecting element 20 acts like a knife which both slices wire insulation 42 and embeds itself into the wire conductor 41 during application of the subject device. On each side of the cutting wedge 21, the connecting element 20 is notched inward to form a ledge 22 which aids in anchoring the connecting element 20 into the housing 10 when placed in service. The connecting element base 23 is a tongue which is fixed into the insulating fastener 30 and acts as a tang to hold the connecting element 20 in position during the application process.

Figure 2:
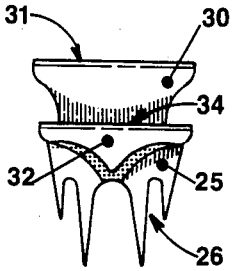

Referring to FIG.2, the connecting element 20 may also be specifically shaped to facilitate a connection with stranded wires. The connecting element for stranded wires 25 is similar in shape to the connecting element for solid wires 20 with the distinction of having a deeply surrated cutting wedge 26. The serrated serves to penetrate the wire insulation 42 without slicing completely through it. The connecting element for stranded wires 25 features the same base configuration as the connecting element for solid wires 20 and is fixed into the insulating fastener 30 in the same manner.

Referring to FIG.2 and FIG.3, the insulating fastener 30, fixed onto the connecting element 20, is a clasping mechanism which is sized and shaped to compliment the slot 11 in the housing 10. The top of the fastener 31 resembles the head of a tack and performs a similar function by receiving impact during application of the subject device and by preventing the fastener 30 from sinking past the outer surface of the housing 10. The base of the fastener 32 features several gradual incline planes 33 which serve to stretch the slot 11 open as the fastener is driven into the housing 10. As the fastener 30 is driven to its closed position, the slot 11 is allowed to close by an abrupt return in the surface of the incline planes 33. The said return forms a ledge 34, located near the middle of the fastener 30, which serves as a catch to lock the fastener 30 into the housing 10. The fastener 30 is slotted along its central transverse plane to receive and envelop the base 23 of the connecting element 30.

Referring to FIG.4 and FIG.5, the profile of the slot 11 is shaped so as to provide a compliment to the fastener 30. The walls of the slot 11 are inclined inversely to the incline planes 33 of the fastener 30 to form a funneling guide which maintains the orientation of the connecting element 20 as it travels toward its closed position.

Referring to FIG.4 and FIG.5, the subject device is shown in its open configuration. The connecting element 20 is aligned with the slot 11 and is positioned outside the internal cavity 13 to allow the connected wires 40 to enter the housing 10 without obstruction. The connected wires 40 are inserted into the housing 10 such that the wire conductors 41 are extended substantially beyond the plane in which the connecting element 20 lies.

Figure 6:
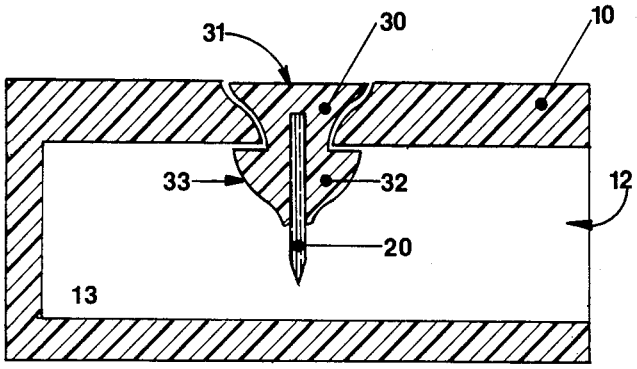
Figure 7:
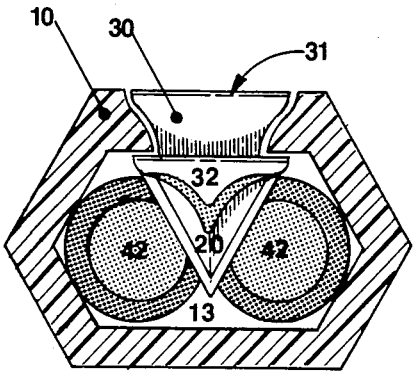

Referring to FIG.6 and FIG.7, the subject device is shown in its closed configuration. The cutting wedge 21 of the connecting element 20 has sliced through or penetrated the wire insulation 42 and embedded itself into the wire conductors 41. The fastener 30 is clasped into the slot 11 in the housing 10 which locks the connecting element 20 in place and traps the connected wires 40 into the device.

Figure 8:
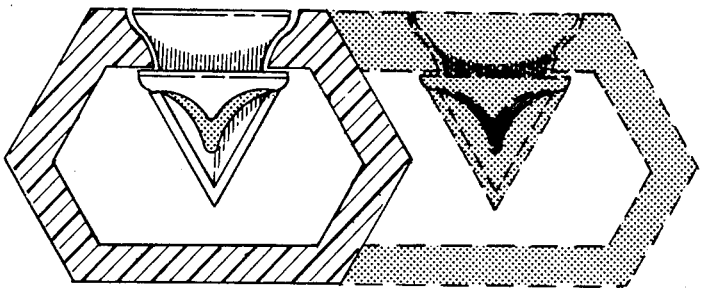

Referring to FIG. 8, the subject device can be expanded to accommodate the connection of more than two wires by widening the subject deivce transversely. FIG.8 illustrates the principle of how the basic design of the subject device can be repeated to provide for the connection of three or more wires. The modified housing is widened transversely to accommodate additional wires. The modified connecting element has two or more cutting wedges attached side by side with a common base. The modified fastener is configured to follow the pattern of the modified connecting element.

Referring to FIG. 4., the subject device can be manufactured to be waterproof by filling the internal cavity 13 with an insulating and waterproof yet pliable compound such as silicone, latex or grease. The compound contained in the internal cavity 13 of the housing 10 is preserved and contained prior to use by a penetrable membrane 14 which seals the openings in the housing 10. During application, the membrane 14 is pierced by the entry of the connected wires 40 and the insertion of the connecting element 20. As the connected wires 40 and the connecting element 20 are forced into the housing 10, the waterproofing compound is injected throughout the internal cavity 13 thereby engulfing the conductive components of the connection.

What is claimed is:

1. An electrical wire connector specifically adapted for mechanical application by the action of an impact force comprising:

a one-piece insulating housing comprised of a flattened hollow cylinder with a single opened end through which electrical wires are inserted into the said insulating housing wherein the said insulating housing closely cradles the electrical wires and encapsulates the ends of the electrical wires within an electrically insulated casing;

a slot with inclined edges forming a funnel-like shape that passes through the top wall of the said insulating housing located near the midsection and positioned generally perpendicular to the longitudinal axis of the said insulating housing wherein the said slot functions to provide access to the electrical wires encapsulated within the said insulating housing;

a resilient, conductive connecting element shaped like an arrowhead comprising a sharpened, cutting wedge on its lower portion, inward notches on each side above the said cutting wedge and a rectangular base portion located on top of the said cutting wedge wherein the point of the said cutting wedge is inserted into the said slot and is driven into the electrical wires held within the said insulating housing thereby acting to embed the said cutting wedge into the electrical wires forming an electrical connection while simultaneously wedging the electrical wires against the walls of the said insulating housing to secure a firm physical connection;

an insulating fastener, fixed onto the base of the said connecting element, which has an upper portion shaped like the head of a tack, a lower portion shaped with inclined planes to form a wedge-like body and inward ledges at the upper portion of the said wedge-like body generally located at the midsection of the said fastener wherein the upper portion of the said fastener serves to receive and transmit an applied impact force to the said connecting element and wherein the lower portion of the said insulating fastener serves to guide the said connecting element into the said slot and to clasp into the said slot as the said fastener is moved to its closed position thereby locking the said connecting element within the said insulating housing.

2. The connector of claim 1 wherein the internal cavity of the said insulating housing is filled with an insulating and waterproofing yet pliable material that is contained and protected prior to use by a thin penetrable membrane which is pierced during the connection process allowing the insulating and waterproofing material to engulf the ends of the connected wires thereby insulating the conducting materials from contact with water.

3. The connector of claim 1 wherein the said connecting element is modified to accomodate the connection of stranded wires by placing deep serrations in the cutting wedge of the said connecting element.

4. The connector of claim 1 wherein the said connecting element is modified to connect both stranded and solid wires in a single connector by placing shallow serration in the cutting wedge of the said connecting element.

5. The connector of claim 1 wherein the said insulating housing, the said connecting element and the said insulating fastener are expanded and modified to accomodate the connection of more than two wires within a single device.

* * * * *